US011854722B2

(12) United States Patent
Dubois et al.

(10) Patent No.: US 11,854,722 B2
(45) Date of Patent: Dec. 26, 2023

(54) POWER CABLE WITH INTEGRATED FILTER

(71) Applicant: THALES, Courbevoie (FR)

(72) Inventors: Eric Ravindranath Dubois, Chatou (FR); Hocine Kherbouchi, Chatou (FR); Sebastien Chenet, Chatou (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 17/535,772

(22) Filed: Nov. 26, 2021

(65) Prior Publication Data

US 2022/0165454 A1 May 26, 2022

(30) Foreign Application Priority Data

Nov. 26, 2020 (FR) ..... 2012219

(51) Int. Cl.
*H01B 9/02* (2006.01)
*H01B 9/00* (2006.01)

(52) U.S. Cl.
CPC ..... *H01B 9/006* (2013.01)

(58) Field of Classification Search
CPC . H01B 3/004; H01B 3/04; H01B 3/08; H01B 3/47; H01B 3/48; H01B 7/02; H01B 7/18; H01B 9/003; H01B 9/006
USPC ..... 174/28, 102 R, 108, 110 R, 113 R, 174/120 R–122 R
See application file for complete search history.

(56) References Cited

U.S. PATENT DOCUMENTS 1,008,370 A * 11/1911 Robillot ..... H01B 11/04 57/212
2,483,913 A * 10/1949 Lampton ..... B64C 11/12 416/136
2,508,479 A * 5/1950 Wheeler ..... H01Q 19/08 333/22 R
2,603,707 A * 7/1952 Jaynes ..... H01B 11/1895 333/244
2,911,333 A * 11/1959 Harold ..... H01P 1/202 333/260
3,191,132 A * 6/1965 Mayer ..... H01B 11/12 333/184
3,238,477 A * 3/1966 Brueckmann ..... H01B 11/14 333/243

(Continued)

FOREIGN PATENT DOCUMENTS

BE 627 706 A 5/1963
EP 0 036 746 A2 9/1981

(Continued)

*Primary Examiner* — William H. Mayo, III
(74) *Attorney, Agent, or Firm* — BakerHostetler

(57) ABSTRACT

A power cable for transmitting electrical power includes at least two electrical conductors extending mainly along a power transmission axis. A first of the conductors called the external conductor surrounds a second of the conductors called the internal conductor along the axis. At least one insert is arranged between the internal conductor and the external conductor. The insert extends over only part of the cable along the axis. The insert introduces a first impedance between the internal conductor and the external conductor with a value different from a second impedance between the internal conductor and the external conductor outside of the part of the cable over which the insert extends.

18 Claims, 4 Drawing Sheets

(56) References Cited

U.S. PATENT DOCUMENTS 3,271,506 A * 9/1966 Martin ..... H01B 11/1873 174/99 R
3,541,473 A * 11/1970 Fillar ..... H01P 1/201 174/114 R
3,688,224 A 8/1972 Suetake et al.
3,996,414 A 12/1976 Artbauer et al.
4,161,704 A * 7/1979 Schafer ..... H01P 1/202 333/33
4,266,207 A * 5/1981 Schafer ..... H01P 1/202 333/206
4,329,667 A * 5/1982 Schafer ..... H01P 3/06 333/206
4,506,235 A * 3/1985 Mayer ..... H01B 11/06 333/236
4,843,356 A * 6/1989 Lusignan ..... H01B 11/146 333/236
5,262,593 A * 11/1993 Madry ..... H01B 11/1856 174/29
6,943,300 B2 * 9/2005 Ekeberg ..... H01B 7/14 174/113 C
7,355,495 B2 * 4/2008 Lo Hine Tong ..... H01P 1/202 333/206
7,705,238 B2 * 4/2010 Van Swearingen ..... H01P 3/06 174/113 AS
2001/0020542 A1 * 9/2001 Schuren ..... H01B 9/027 174/126.4
2013/0248240 A1 * 9/2013 Glew ..... H05K 9/0098 174/388
2016/0111184 A1 * 4/2016 Gogola ..... H01B 1/02 174/130

FOREIGN PATENT DOCUMENTS

FR 48 227 E 11/1937
FR 879 077 A 2/1943
JP S50-40990 Y1 11/1975

* cited by examiner

POWER CABLE WITH INTEGRATED FILTER

CROSS-REFERENCE TO RELATED APPLICATIONS

This application claims priority to foreign French patent application No. FR 2012219, filed on Nov. 26, 2020, the disclosure of which is incorporated by reference in its entirety.

FIELD OF THE INVENTION

The invention relates to a power cable for transmitting electrical power. The invention is particularly, but not exclusively, of use in the aerospace field.

BACKGROUND

An aeroplane generally comprises a large number of electric machines or electrical loads that are supplied with electrical power by an on-board electrical supply network. For example, the flight controls, and the air-conditioning and internal lighting systems, employ three-phase AC electric machines. Other electric machines may operate with direct current. The electrical powers delivered to these machines are provided by means of power conversion devices connected to the on-board network, which is itself supplied with power by electric generators and storage batteries arranged on board the aircraft, or else by means for connecting to an electrical power supply network on the ground, allowing the aircraft to be supplied with electrical power on the tarmac.

For high power requirements, it is advantageous to decrease the cost, weight and bulk of the power conversion devices, for example by combining a plurality of converters in parallel to supply an electric machine with power. The conversion device then comprises a plurality of converters supplied with power by the electrical network and driven by a common control member. The AC or DC currents from each of the converters are linked, or coupled, by means of one or more inductances. The conversion device also generally comprises filtering means at the input of the converters, on the on-board network side, for differential mode and for common mode, and filtering means at the output of the converters after coupling.

The filtering means are generally integrated into the converters or arranged in the immediate vicinity of the converters. The filtering means mainly consist of inductive elements formed of electrical conductors wound around magnetic cores. The wound electrical conductors must withstand the strength of the current flowing through them which dictates substantial conductor cross sections and weights. The magnetic cores around which the conductors are wound are also bulky and heavy. The filtering means may also comprise other passive components such as capacitors. Generally, the filtering means tend to substantially increase the on-board weight and occupy substantial volumes on board aircraft. This problem is also significant, even in the absence of any converter, in limiting the effects of interference in power transmission networks. The interference may be due to equipment connected to the network, generators or loads, or to external effects that might influence the networks.

SUMMARY OF THE INVENTION

The invention aims to overcome all or some of the problems mentioned above by proposing a reduction in the filtering required at the level of electrical equipment and in particular converters by integrating a filtering means into the power cables transmitting an electrical power supply.

To that end, the subject of the invention is a power cable for transmitting electrical power, comprising:

at least two electrical conductors extending mainly along a power transmission axis, a first of the conductors called the external conductor surrounding a second of the conductors called the internal conductor along the axis, at least one insert comprising a ferromagnetic material, the insert being arranged between the internal conductor and the external conductor without the ferromagnetic material forming a closed loop around the internal conductor along the axis, the insert extending over only part of the cable along the axis, the insert introducing a first impedance between the internal conductor and the external conductor with a value different from a second impedance between the internal conductor and the external conductor outside of the part of the cable over which the insert extends.

Advantageously, the ferromagnetic material has a relative magnetic permeability higher than 30 000.

Advantageously, the at least one insert made of ferromagnetic material has a convex envelope surface not surrounding the internal conductor.

Advantageously, the insert is in the shape of a portion of a cylinder extending parallel to the axis.

Advantageously, the power cable comprises a plurality of inserts made of ferromagnetic material having a convex envelope surface not surrounding the internal conductor and embedded in a dielectric material extending over only part of the cable along the axis.

Advantageously, the insert is in the shape of a ring inside which the internal conductor extends, the ring being split so as not to produce a closed loop around the internal conductor.

The split ring shape is advantageously fitted both to the interior of the external conductor and around the internal conductor.

In addition to the ferromagnetic material, the insert may also comprise a metal material that is insulated from at least one of the conductors or else a dielectric material whose permittivity is different from the permittivity present outside of the region where the insert is located.

The power cable may comprise a plurality of internal conductors surrounded by the external conductor. In this case, the power cable advantageously comprises a core extending along the axis, the core being configured to hold the internal conductors apart from one another and pressed against the insert, the core introducing an impedance between the internal conductors with a value different from the impedance between the internal conductors outside of the part of the cable over which the core extends. Advantageously, the core forms the insert made of ferromagnetic material.

Advantageously, the power cable comprises an outer ring made of ferromagnetic material, the outer ring being arranged in a section of the cable perpendicular to the power transmission axis in which the insert is arranged, the insert being made of ferromagnetic material with a relative magnetic permeability lower than the relative magnetic permeability of the outer ring.

The power cable may comprise a plurality of internal conductors surrounded by the external conductor, the insert potentially being arranged between one of the internal conductors and the external conductor without being arranged between the other internal conductors and the external conductor.

The insert may comprise radial and/or axial irregularities along the power transmission axis.

The insert may be formed of the assembly of various parts, each formed from different materials.

The power cable may comprise an end connection making it possible to connect, to one end of the cable, the two electrical conductors and at least one current connection making it possible to connect, along the cable, the two electrical conductors, the insert being advantageously arranged between the end connection and the current connection and/or arranged between different outputs of the connection.

The power cable may comprise a plurality of current connections making it possible to connect, along the cable, the two electrical conductors, the insert being arranged between at least two of the current connections.

BRIEF DESCRIPTION OF THE DRAWINGS

The invention will be understood better and further advantages will become apparent from reading the detailed description of an embodiment given by way of example, this description being illustrated by the appended drawings, in which.

For the sake of clarity, elements that are the same have been designated with the same references in the various figures.

DETAILED DESCRIPTION

Figure 1:
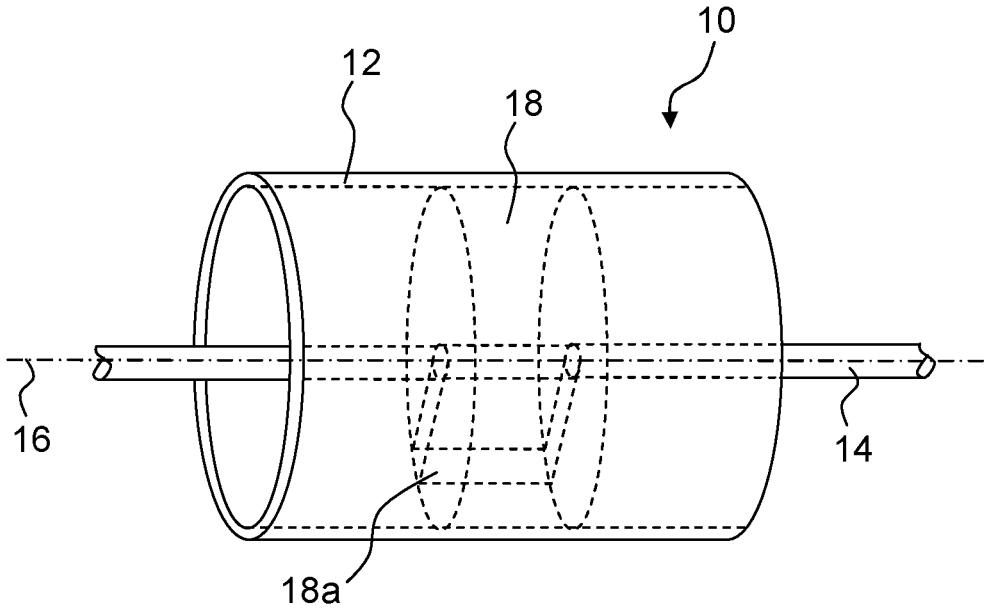
FIG. 1 shows a cable designed to transmit a DC or single-phase current.

FIG. 1 shows one coaxial power cable 10 comprising two electrical conductors 12 and 14. The cable 10 is designed to transmit power as DC or as single-phase AC. The two electrical conductors 12 and 14 extend mainly along a power transmission axis 16. In other words, the axis 16 is the axis of the cable. In FIG. 1, the axis 16 is rectilinear. The axis 16 may also be curved. The two electrical conductors 12 and 14 may be rigid or flexible, allowing the axis 16 to curve. The conductor 12 surrounds the conductor 14 along the axis 16, hence the generic term "coaxial cable". In FIG. 1, the conductor 14 is a bulk conductor extending along the axis 16 and the conductor 12 is in the shape of a tube of circular section centred on the axis 16. Other conductor shapes are possible within the scope of the invention. The two conductors 12 and 14 are not necessarily coaxial. The invention may be implemented whenever one conductor surrounds another conductor. Hereinafter, the conductor 12 will be called the external conductor and the conductor 14 will be called the internal conductor.

Figure 2:
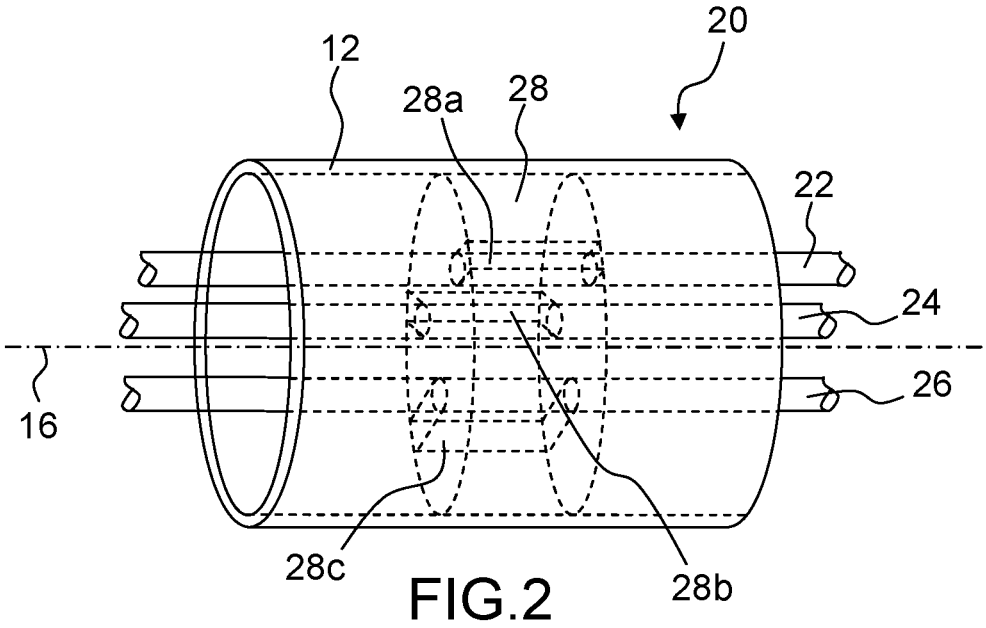
FIG. 2 shows a cable designed to transmit a three-phase current.

FIG. 2 shows another coaxial power cable 20 comprising a plurality of internal conductors, three conductors 22, 24 and 26 in the example shown. The three conductors 22, 24 and 26 extend along the axis 16 and parallel thereto. The three conductors 22, 24 and 26 are surrounded by the conductor 12, similar to that of FIG. 1. The cable 20 is well suited for transmitting a three-phase current. Each phase is conveyed by one of the conductors 22, 24 and 26. The conductor 12 may convey a neutral of the electrical system. The invention may be used regardless of the number of phases. One internal conductor is provided per phase. All of the internal conductors are surrounded by the external conductor 12.

The cables 10 and 20 are of particular use on board an aircraft for conveying electrical power between a source and a load. This cable may be implemented in any other type of vehicle implementing an electrical network and even more generally whenever electrical filtering is required, even in a fixed apparatus.

According to the invention, the cables 10 and 20 each comprise one or more inserts arranged between the internal conductor and the external conductor. In FIG. 1, the cable 10 comprises an insert 18 and in FIG. 2, the cable 20 comprises an insert 28. The inserts 18 and 28 extend over only part of the cable in question, 10 or 20, along the axis 16. The inserts 18 and 28 modify the impedance present between the one or more internal conductors and the external conductor in the absence of any insert. In other words, locally, the impedance value between the one or more internal conductors and the external conductor is different along the axis 16 at the insert and outside of the region where the insert is located. The impedance adjustment caused by the insert makes it possible to improve the filtering of interference that might propagate via the cable. The choice of the position of an insert makes it possible to perform filtering that has the best possible physical position inside the cable to limit the effects of the interference. It may be advantageous to have the insert as close as possible to a point where interference enters the cable. It may also be advantageous to have a specific impedance further from the point of entry in order to take advantage of coupling between the specific impedance of the insert and the impedance of the cable itself without any insert. In a coaxial cable, the invention makes it possible to arrange the insert at the desired location along the axis 16 without modifying the outer geometry of the cable. In other words, the insert is completely integrated into the cable. No specific volume has to be provided for the positioning of a filter of any sort.

The insert comprises a ferromagnetic material. This type of material makes it possible to generate an inductive part in the specific impedance of the insert. To prevent the current flowing through the one or more internal conductors from generating a rotating magnetic flux in the insert around the one or more internal conductors, the insert is configured so as not to form a loop around the one or more internal conductors. The absence of any loop around the one or more internal conductors makes it possible to prevent the ferromagnetic material of the insert from becoming saturated when large currents flow through the one or more internal conductors.

Different types of shape may be implemented in order to avoid forming a loop around the one or more internal conductors. By way of example, in FIG. 1, the insert 18 is in the shape of a portion of a cylinder along the axis 16, pierced along the axis 16 for the passage of the central conductor 14 and comprising a radial slot 18*a* extending from the internal conductor 14 to the external conductor 12. Similarly, in FIG. 2, the insert 18 is also in the shape of a portion of a cylinder along the axis 16, pierced for the passage of each of the internal conductors 22, 24 and 26, and comprising, associated with each of the internal conductors 22, 24 and 26, a radial slot 28*a*, 28*b* and 28*c*, respectively, extending from the respective internal conductor to the external conductor.

For the ferromagnetic material, it is possible to choose its permeability according to the filtering that it is desired to carry out. Advantageously, a material with high relative permeability is chosen which makes it possible to obtain a high value for the inductive part of the specific impedance of the insert. The maximum relative permeability, typically denoted by $\mu_r$, links, in a linear domain, the magnetic field B and the excitation magnetic field H created by the moving current. It is generally considered that materials with high relative permeability have a value of $\mu_r$ higher than 30 000. The measurement of the maximum relative magnetic permeability may be performed for a magnetic excitation of 100 mA/cm at a frequency of 10 kHz. Many manufacturers of magnetic materials display the maximum relative permeability value with a tolerance of +/−15% in their catalogue. This type of measurement with its tolerance may be taken into account in the context of the invention.

In FIGS. 1 and 2, each of the cables 10 and 20 comprises just one insert. In the context of the invention, each of cables 10 and 20 may comprise a plurality of inserts and, more specifically, as many as needed to produce an adequate filter.

The inserts 18 and 28 are made of materials that have different magnetic properties from the material located between the one or more internal conductors and the external conductor in the absence of any insert. Outside of the region where the insert is located, the internal and external conductors may simply be separated by air while still providing the required insulation. Additionally, air has a dielectric permittivity close to that of vacuum. The permittivity provides the presence of a capacitance distributed along the cable between the one or more internal conductors and the external conductor. Air is very straightforward to implement and makes it possible to arrange an insert at a desired location along the axis 16. The presence of air makes it possible to easily move the insert when needed. Alternatively, outside of the region where the insert is located, it is possible to arrange other, solid or even fluid, materials between the one or more internal conductors and the external conductor, in particular by choosing the material to adapt its relative permeability.

In addition to the ferromagnetic material, the insert may comprise an electrically conductive material while providing electrical insulation with respect to at least one of the conductors. A conductive material makes it possible to decrease the distance separating the external conductor from the one or more internal conductors, which makes it possible to increase the value of the capacitance separating the one or more internal conductors from the external conductor.

Still in addition to the ferromagnetic material, the insert may comprise a dielectric material whose permittivity may be chosen so as to modify the capacitance present outside of the region where the insert is located. For example, glass has a permittivity of the order of 5 to 7, which makes it possible to locally increase the capacitance present between the one or more internal conductors and the external conductor.

It is also possible to act on a difference in magnetic permeability between the material of the insert and that separating the conductors outside of the region where the insert is located. To that end, the insert may comprise, in addition to the ferromagnetic material, a diamagnetic or paramagnetic material. By increasing the magnetic permeability, the insert may increase the inductance value between the one or more internal conductors and the external conductor.

FIGS. 3, 4, 5 and 6 show, in section along a plane perpendicular to the axis 16, various exemplary insert shapes. In the various shapes proposed, the material of the insert may be chosen according to the impedance value that it is desired to provide by means of the insert. It is possible to produce an insert comprising just one material. Alternatively, it is possible to produce a composite insert combining different materials in order to best adjust the local impedance provided by the insert.

Figure 3:
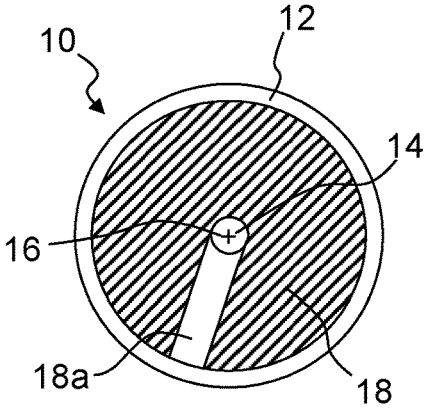
FIGS. 3, 4, 5, 6, 7 and 8 show exemplary inserts introduced into the cables shown in FIGS. 1 and 2.
Figure 4:
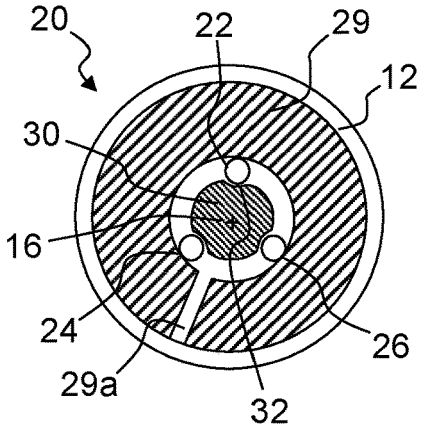

FIG. 3 shows the insert 18 in the shape of a ring fitted both to the interior of the external conductor 12 and around the internal conductor 14. The two fits make it possible to mechanically maintain the position of the internal conductor 14 with respect to the external conductor 12. In FIG. 4, the conductors 12 and 14 are coaxial. It is also possible to offset the conductor 14 with respect to the axis 16. It is possible to see the slot 18*a* preventing the insert 18 from forming a loop around the internal conductor 14. The slot 18*a* may have a width that is sufficient for the placement of the internal conductor 14. The insert 18 may be made completely of ferromagnetic material in which the slot 18*a* is made. The slot 18*a* may be a simple opening in which air is present. It is also possible to fill the opening with a solid, non-ferromagnetic material, for example a dielectric material, in order to ensure the mechanical strength of the insert 18. The width of the slot 18*a* is defined so as to form a sufficient air gap limiting the magnetic flux rotating around the central conductor 14.

FIG. 4 shows an insert 29 in the shape of a ring as a portion of a cylinder along the axis 16 and fitted both to the interior of the external conductor 12 and around the internal conductors 22, 24 and 26. The insert 29 may be made of ferromagnetic material and then comprises a radial slot 29*a* extending from the internal conductors 22, 24 and 26 to the external conductor 12. To keep the internal conductors 22, 24 and 26 pressed against the insert 29, the cable 20 may comprise a central core 30 allowing the internal conductors 22, 24 and 26 to be held apart from one another. The central core 30 may comprise grooves 32 in each of which an internal conductor is situated. The grooves 32 allow the internal conductors 22, 24 and 26 to be positioned with respect to one another. The central core 30 may be made of a material exhibiting electromagnetic properties different from those of air and in particular be made of ferromagnetic material. In other words, the central core 30 introduces an impedance between the internal conductors 22, 24 and 26 with a value that is different from the impedance between the internal conductors 22, 24 and 26 outside of the portion in which the central core 30 extends. When the central core 30 is made of ferromagnetic material, it forms an insert within the meaning of the invention. Specifically, for each of the internal conductors 22, 24 and 26, the central core 30 is arranged between the internal conductor in question and the external conductor 12. In addition, the central core 30 does not form a closed loop around the internal conductor in question, along the axis 16. The material of the insert 29 and that of the core 30 may be the same or different. The choice of materials is made according to the impedances that it is desired to obtain, on the one hand between the internal conductors 22, 24 and 26 and the external conductor 12 and on the other hand between the internal conductors 22, 24 and 26 themselves.

Alternatively, in the variant shown in FIG. 4, it is possible to omit the core 30 by attaching the internal conductors 22, 24 and 26 to the insert 28, for example by bonding.

Figure 5:
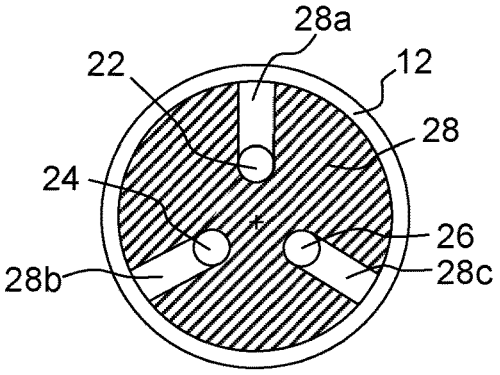

FIG. 5 shows the insert 28 implemented in a cable 20 with a plurality of internal conductors 22, 24 and 26. As mentioned with reference to FIG. 2, the insert 28 comprises as many radial slots 28*a*, 28*b*, 28*c* with respect to the axis 16 as there are internal conductors 22, 24 and 26, respectively. The slots 28*a*, 28*b*, 28*c* are adjusted so as to insert the internal conductors 22, 24 and 26 thereinto. Like above for the insert 18, the slots 28*a*, 28*b*, 28*c* may be kept free of material, i.e. filled with air, or filled with a solid, non-ferromagnetic material.

The variant of FIG. 5 initially appears more straightforward to implement than the variant of FIG. 4. Specifically, the mechanical function performed by the central core 30 in FIG. 4 is directly performed by the insert 28 in FIG. 5. However, to produce some inserts, it may be necessary to implement a winding-based manufacturing process. This is particularly the case for rings generally used as magnetic circuits based on nanocrystalline ferromagnetic materials. These materials have the advantage of very high relative permeability $\mu_r$ which may exceed $10^5$. These rings are often called toric magnetic circuits by manufacturers because of the absence of any air gap. Nanocrystalline materials are difficult to machine. It is therefore almost impossible to produce the slots in the inserts 18, 28 and 29 with such materials, hence the usefulness of a form such as that of the core 30.

Figure 6:
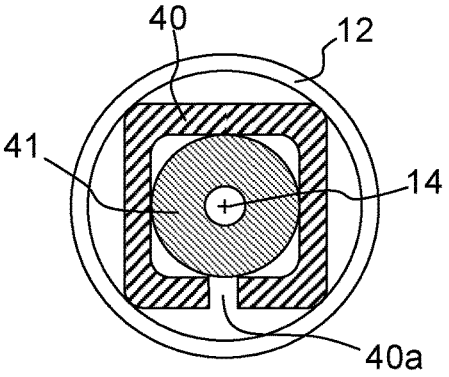

The inserts 18, 28 and 29 shown in FIGS. 3, 4 and 5 have outer shapes that conform to the inner surface of the external conductor 12. This makes it possible to maximize the amount of material of the insert between the one or more internal conductors and the external conductor and thus maximize the difference in impedance value between the insert and the region of the cable from which the insert is absent for a given material implemented for the insert. Alternatively, it may be useful not to conform to the inner surface of the external conductor 12 in order to create irregularities in the impedance generated by the insert. Such irregularities make it possible for an insert made of ferromagnetic material to introduce losses allowing potential resonances caused by an overly perfect impedance to be limited. One example of such an embodiment is shown in FIG. 6 in which the external conductor 12 is in the shape of a tube with a circular cross section around the axis 16. The insert 40 has a substantially square cross section inscribed within the external conductor 12. Like above, the insert 40 has a slot 40*a* for preventing the formation of a loop around the internal conductor 14. The vertices of the square cross section make contact with the inner surface of the external conductor 12 and the sides of the square cross section are distanced from the inner surface of the external conductor 12, in particular at their midpoints. The air present between the sides and the external conductor 12 tends to locally decrease the impedance obtained by the insert 40 locally at the vertices. The variations in local impedance in radial directions around the axis 16 make it possible to decrease potential resonances caused by an overly perfect impedance. In addition, the losses generated by the creation of air gaps at the sides tend to promote a certain degree of heating which makes it possible to dissipate the energy from interference that it is desired to filter by means of the insert. It is possible to fill the space present between the edges and the inner surface of the internal conductor with another material.

The irregularities in radial shape between the insert and the external conductor may be useful for any other type of material implemented for the insert. As seen above, it is possible to increase the capacitance of the impedance present between an internal conductor and the external conductor by means of an insert made of conductive material or of dielectric material exhibiting a permittivity different from that of the region of the cable without any insert. The radial irregularities in the shape of the insert make it possible to produce local variations in capacitance limiting potential resonances.

The internal conductor 14 may be in contact with the inner surfaces of the insert 40. Alternatively, as shown in FIG. 6, a spacer 41 may ensure the positioning of the internal conductor 14 with respect to the insert 40. It is of course possible to take advantage of the placement of the spacer 41 to produce an impedance adjustment by choosing the electromagnetic properties of the material of the spacer.

Figure 7:
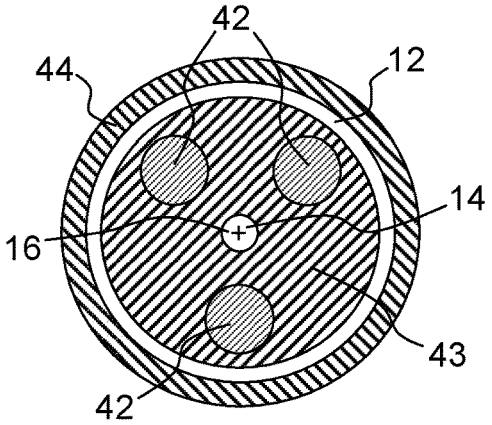

FIG. 7 shows one variant implementing a plurality of inserts 42 made of ferromagnetic material arranged around the internal conductor 14. In the example shown, the inserts 42 are each in the shape of a portion of a cylinder of circular cross section extending along axes parallel to the axis 16 and at a distance therefrom. The inserts 42 are held in position between the internal conductor 14 and the external conductor 12 by means of a spacer 43 fitted inside the external conductor 12 and pierced so as to accommodate the internal conductor 14 and the inserts 42. The internal conductor 14 and the inserts 42 are each arranged in distinct piercings. In the example shown, the spacer 43 forms a closed loop around the internal conductor 14 and it is made of a non-ferromagnetic material which may however participate in the filtering, for example by having a dielectric constant different from that of the material separating the conductors 14 and 16 outside of the region in which it extends. Producing inserts 42 of circular cross section is straightforward and as mentioned above, it is easy to make them from nanocrystalline material. Alternatively, other shapes of inserts 42 are possible and in particular other shapes of cylindrical cross section, or even non-cylindrical cross section. It is, for example, possible to embed beads of ferromagnetic material in a spacer 43, for example made of dielectric resin. To ensure that the ferromagnetic materials of each bead do not touch, risking the promotion of magnetic field lines surrounding the internal conductor, even partially, it is possible to coat each bead with a continuous layer of dielectric material. The coated beads are then embedded in a dielectric resin. More generally, the insert made of ferromagnetic material may have a convex envelope surface not surrounding the internal conductor 14. In addition, the invention may be implemented regardless of the number of inserts 42. The one or more inserts 42 may also be implemented in a power cable having a plurality of internal conductors. This type of embodiment makes it possible to locally increase the inductance between the one or more internal conductors 14 or 22, 24, 26 and the external conductor 12 by means of inserts made of ferromagnetic material and the capacitance between the one or more internal conductors 14 or 22, 24, 26 and the external conductor 12 by means of the dielectric material.

In addition, it is possible to add an outer ring 44 making it possible to locally modify the impedance of the cable 10. It is, for example, possible to make the outer ring 44 of ferromagnetic material able to filter certain high-frequency common-mode currents which may in particular propagate over the outer surface of the external conductor 12. It is advantageous to combine, in one and the same section of the cable 10, which section is perpendicular to the axis 16, an insert, whatever its form as described above, and an outer ring 44. Specifically, it is subject only to the differential current between the two conductors 12 and 14. The outer ring 44 is therefore less subject to the risk of saturation and may be made of a ferromagnetic material of high relative magnetic permeability. The implementation of an outer ring 44 may be envisaged regardless of the number of internal conductors.

Figure 8:
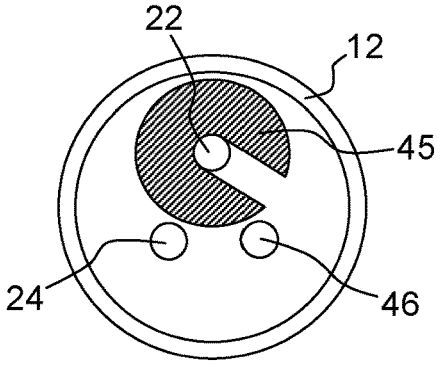

FIG. 8 shows yet another cable variant comprising a plurality of internal cables. In the example shown, the three internal conductors 22, 24 and 26 are present again. It is possible to adapt this variant whatever the number of internal conductors. An insert 45 is arranged between one of the internal conductors, the conductor 22 in the example shown, and the external conductor 12, without being arranged between the other internal conductors 24, 26 and the external conductor 12. Other inserts 45 may be arranged around each of the internal conductors 24 and 26 in sections of the cable other than that shown in FIG. 8.

Figure 9:
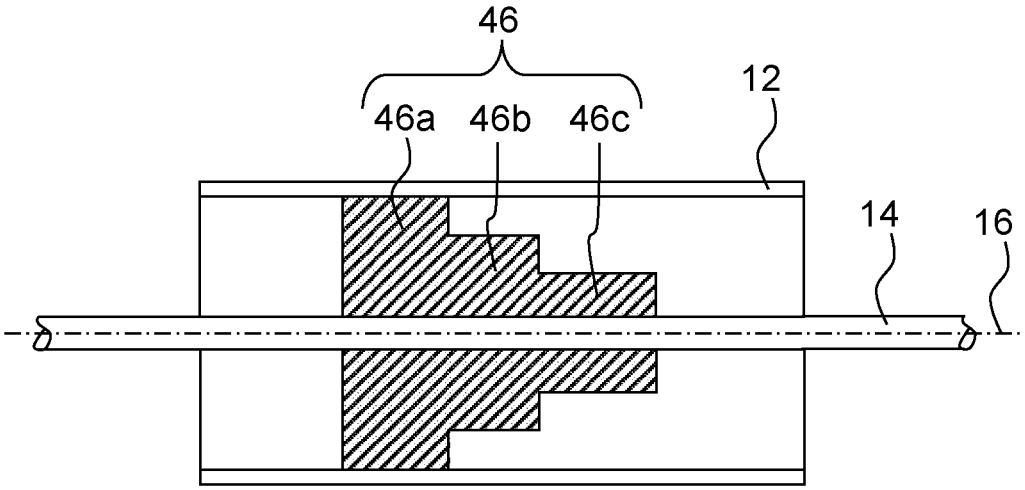
FIGS. 9 and 10 show different exemplary shapes of possible inserts introduced into the cables shown in FIGS. 1 and 2.

FIG. 6 shows radial irregularities between one of the internal and/or external conductors and the insert 40. FIG. 9 shows another variant shape of insert 46 in which irregularities in axial shape are present. In the example shown, the insert 46 is pierced axially along the axis 16 to accommodate the internal conductor 14 in a fitted manner. The insert 46 comprises a first part 46*a*, the outer surface is fitted inside the external conductor 12. The insert 46 comprises two other parts 46*b* and 46*c* forming steps with respect to the part 46*a*. Thus, air, or another material, is present between the parts 46*b* and 46*c* and the external conductor 12. These axial irregularities in shape make it possible to axially modify the impedance created by the insert 46. Any other irregular shape is of course possible. It is also possible to produce an insert exhibiting irregularities in shape both axially and radially. Like for the insert 40 shown in FIG. 6, for the insert 46, it is possible to choose the type of ferromagnetic material of which it consists to adapt the impedance as needed. To avoid forming a loop around the internal conductor 14, the insert 46 comprises a radial slot as illustrated above, and it is also possible to provide axial irregularities for other shapes of insert, and in particular for the inserts 42 shown in FIG. 7.

Figure 10:
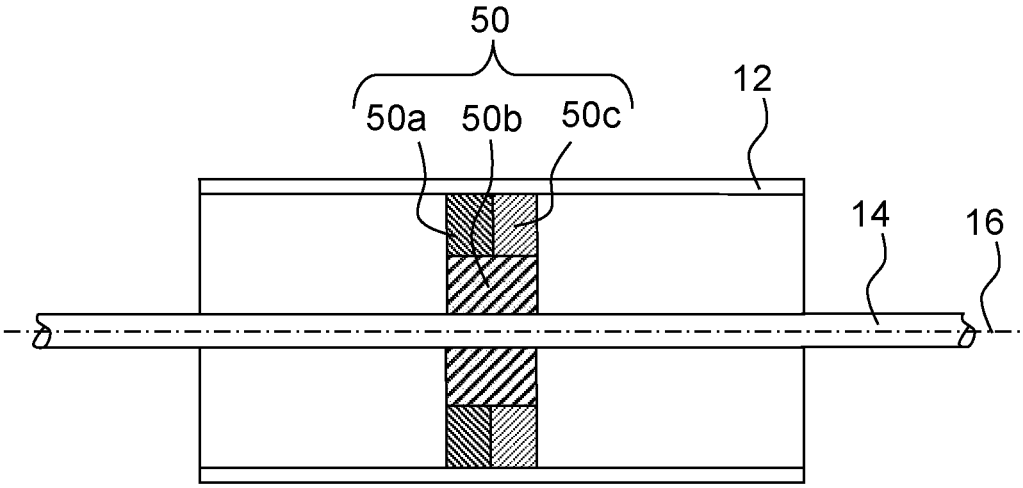

FIG. 10 shows an insert 50 formed of the assembly of various parts, each formed from materials that may be different and at least one of which comprises a ferromagnetic material which does not form a loop around the internal conductor 14. In the example shown, the insert 50 comprises three components 50*a*, 50*b* and 50*c*. This type of assembly is advantageous when the production of a tailored insert, both in terms of its dimensions and in terms of its electromagnetic characteristics, would be industrially difficult to achieve. It is possible to closely approach the desired characteristics by assembling together different components of different natures. The insert 50 may be regular in shape as shown in FIG. 10. It may also comprise irregularities in shape both axially and radially.

FIGS. 9 and 10 are shown in relation to a cable comprising just one internal conductor 14. It is also possible to implement these variants for cables comprising a plurality of internal conductors.

Figure 11:
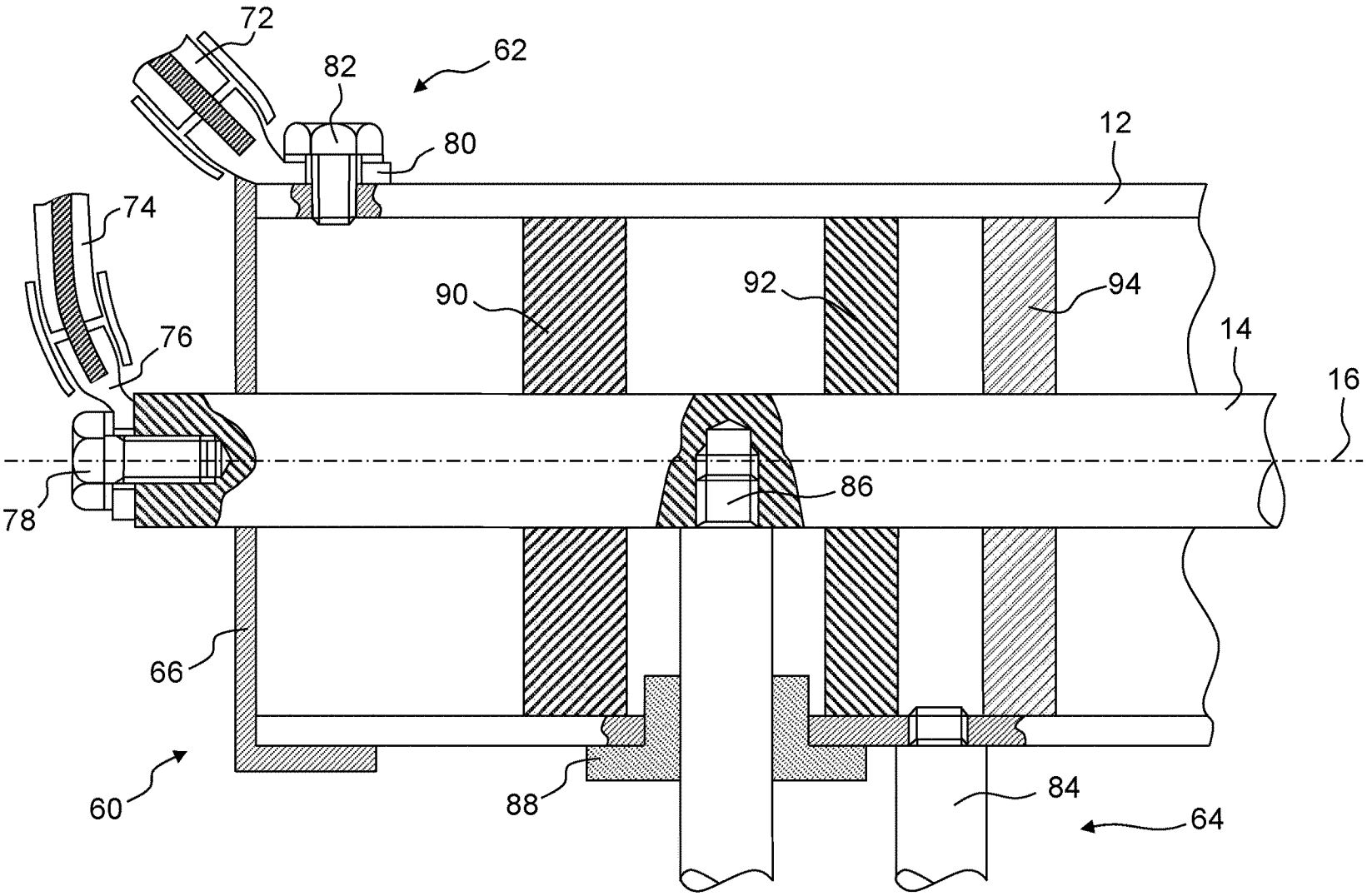
FIG. 11 shows a cable and two connections for the cable.

FIG. 11 shows a cable 60 and two connections 62 and 64 for the cable 60. The cable 60 comprises an internal conductor 14 and an external conductor 12 both extending along the axis 16. The first connection 62, called the end connection, is suitable for connecting the two conductors 12 and 14 at one of the ends of the cable 60. It is possible to implement an end connection at each of the two ends of the cable 60. The second connection 64, called the current connection, is suitable for connecting the two conductors 12 and 14 between the ends of the cable 60. The end connection 62 makes it possible, for example, to connect a generator to the cable 60. The current connection 64 makes it possible, for example, to connect a converter drawing power from the cable. It is possible to make a plurality of current connections 64 along the cable 60 in particular to connect thereto a plurality of converters (or loads) drawing power from the cable 60 in parallel. Conversely, it is possible to connect a plurality of generators or regenerative loads to the cable 60 by means of a plurality of current connections 64. The end connection 62 may also be used to connect an electrical load.

The cable 60 comprises, at one of its ends, a stop 66 that partially covers the external conductor 12. The internal conductor 14 extends beyond the end of the external conductor 12 and passes through the stop 66. The end connection 62 makes it possible to connect, to each of the conductors 12 and 14, an electrical conductor 72 and 74, respectively. The conductor 74 has a lug 76 at its end which is secured to the axial end of the internal conductor 14 by means of a screw 78. Any other means for electrically connecting the conductor 74 to the internal conductor 14 is possible; for example, by means of a collar encircling the internal conductor 14 and providing radial contact around the end of the internal conductor 14. Similarly, the conductor 72 has a lug 80 at its end which is secured to the end of the internal conductor 12 by means of a screw 82. Like above, any other means for electrically connecting the conductor 72 to the internal conductor 12 is possible. More generally, it is possible to implement a connector adapted to the geometry of the cable 60 to provide the connection 62.

The current connection 64 makes it possible to connect the external conductor 12, for example by means of a screw 84, and the internal conductor 14, for example by means of a screw 86 that passes through the external conductor 12. The two screws 84 and 86 extend radially with respect to the axis 16. In FIG. 11, the two screws 84 and 86 extend perpendicular to the axis 16. What is meant by radial is also any direction moving away from the axis 16. When passing through the external conductor 12, the screw 86 is insulated from the external conductor 12 by means of an insulating sleeve 88. Any other means for connection to the two conductors is of course possible. As mentioned above for the connection 62, it is, for example, possible to provide a collar for the electrical contact with each of the conductors 12 and 14.

The radial access to the two conductors 12 and 14 makes it possible to implement as many current connections 64 as necessary. The two connections 62 and 64 are described in relation to a cable having just one internal conductor 14. It is possible to implement these connections for cables having as many internal conductors as necessary.

An insert 90 is arranged between the end connection 62 and the current connection 64. The insert 90 makes it possible to prevent the propagation of interference between the end connection 62 and the current connection 64. A second insert 92 is arranged between the two screws 84 and 86 and more generally between the outputs of the current connection 64, each of the outputs being connected to one of the conductors 12 or 14. It is also possible to arrange the insert 92 between the two outputs of the end connection 62. The impedance-modifying function provided by the insert 92 between the two outputs of the end connection 62 may be fulfilled by the stop 66. In the case of a cable having a plurality of internal conductors, it is possible to arrange an insert 92 between each of the outputs connected to the different conductors. A third insert 94 is arranged beyond the connection 64. In practice, the insert 94 represents an insert arranged between two current connections 64. The inserts 90, 92 and 94 and the stop 66 may comprise a ferromagnetic material without the ferromagnetic material forming a closed loop around internal conductor 14. For that, any shape as described above may be implemented.

The invention claimed is:

1. A power cable for transmitting electrical power, comprising:

at least two electrical conductors extending mainly along a power transmission axis, a first of the conductors called the external conductor surrounding a second of the conductors called the internal conductor along the axis, at least one insert comprising a ferromagnetic material, the insert being arranged between the internal conductor and the external conductor without the ferromagnetic material forming a closed loop around the internal conductor along the axis, the insert extending over only part of the cable along the axis, the insert introducing a first impedance between the internal conductor and the external conductor with a value different from a second impedance between the internal conductor and the external conductor outside of the part of the cable over which the insert extends.

2. The power cable according to claim 1, wherein the ferromagnetic material has a relative magnetic permeability higher than 30 000.

3. The power cable according to claim 1, wherein the at least one insert made of ferromagnetic material has a convex envelope surface not surrounding the internal conductor.

4. The power cable according to claim 3, wherein the insert is in the shape of a portion of a cylinder extending parallel to the axis.

5. The power cable according to claim 3, comprising a plurality of inserts made of ferromagnetic material having a convex envelope surface not surrounding the internal conductor and embedded in a dielectric material extending over only part of the cable along the axis.

6. The power cable according to claim 1, wherein the insert is in the shape of a ring inside which the internal conductor extends, the ring being split so as not to produce a closed loop around the internal conductor.

7. The power cable according to claim 6, wherein the split ring shape is fitted both to the interior of the external conductor and around the internal conductor.

8. The power cable according to claim 1, wherein the insert comprises a metal material that is insulated from at least one of the conductors.

9. The power cable according to claim 1, wherein the insert comprises a dielectric material whose permittivity is different from the permittivity present outside of the region where the insert is located.

10. The power cable according to claim 1, comprising a plurality of internal conductors surrounded by the external conductor and a core extending along the axis, the core being configured to hold the internal conductors apart from one another and pressed against the insert, the core introducing an impedance between the internal conductors with a value different from the impedance between the internal conductors outside of the part of the cable over which the core extends, and wherein the core does not form a closed loop around the internal conductors.

11. The power cable according to claim 10, wherein the core forms the insert made of ferromagnetic material.

12. The power cable according to claim 1, comprising an outer ring made of ferromagnetic material, the outer ring being arranged in a section of the cable perpendicular to the power transmission axis wherein the insert is arranged, the insert being made of ferromagnetic material with a relative magnetic permeability lower than the relative magnetic permeability of the outer ring.

13. The power cable according to claim 1, comprising a plurality of internal conductors surrounded by the external conductor, the insert being arranged between one of the internal conductors and the external conductor without being arranged between the other internal conductors and the external conductor.

14. The power cable according to claim 1, wherein the insert comprises radial and/or axial irregularities along the power transmission axis.

15. The power cable according to claim 1, wherein the insert is formed of the assembly of various parts, each formed from different materials.

16. The power cable according to claim 1, comprising an end connection making it possible to connect, to one end of the cable, the two electrical conductors and at least one current connection making it possible to connect, along the cable, the two electrical conductors, the insert being arranged between the end connection and the current connection.

17. The power cable according to claim 1, comprising at least one connection making it possible to connect, at the end or along the cable, the electrical conductors, the insert being arranged between different outputs of the connection.

18. The power cable according to claim 1, comprising a plurality of current connections making it possible to connect, along the cable, the two electrical conductors, the insert being arranged between at least two of the current connections.

* * * * *